United States Patent [19]

Kowalczyk et al.

[11] 4,422,927

[45] Dec. 27, 1983

[54] PROCESS FOR REMOVING POLYMER-FORMING IMPURITIES FROM NAPHTHA FRACTION

[75] Inventors: Dennis C. Kowalczyk, Pittsburgh; Bruce A. Bricklemyer, Avonmore; Joseph J. Svoboda, Pittsburgh, all of Pa.

[73] Assignee: The Pittsburg & Midway Coal Mining Co., Englewood, Colo.

[21] Appl. No.: 341,234

[22] Filed: Jan. 25, 1982

[51] Int. Cl.[3] ..... C10G 45/00

[52] U.S. Cl. ..... 208/211; 208/48 R; 208/255; 208/264

[58] Field of Search ..... 208/48 R, 211, 255, 208/264

[56] References Cited

U.S. PATENT DOCUMENTS

| | | | |
|---|---|---|---|
| 2,937,131 | 5/1960 | De Chellis | 208/48 R |
| 3,124,526 | 3/1964 | Butler et al. | 208/264 |
| 3,207,802 | 9/1965 | Maerker et al. | 208/255 |
| 3,448,039 | 6/1969 | Tarhan | 208/255 |
| 4,009,094 | 2/1977 | Cole et al. | 208/48 AA |

*Primary Examiner*—Curtis R. Davis
*Assistant Examiner*—O. Chaudhuri
*Attorney, Agent, or Firm*—Deane E. Keith; Forrest D. Stine

[57] ABSTRACT

Polymer precursor materials are vaporized without polymerization or are removed from a raw naphtha fraction by passing the raw naphtha to a vaporization zone (24) and vaporizing the naphtha in the presence of a wash oil while stripping with hot hydrogen to prevent polymer deposits in the equipment.

17 Claims, 2 Drawing Figures

PROCESS FOR REMOVING POLYMER-FORMING IMPURITIES FROM NAPHTHA FRACTION

The Government of the United States of America has rights in this invention pursuant to Contract No. DE-AC05-78ORO3055 awarded by the U.S. Department of Energy to The Pittsburg & Midway Coal Mining Co., a subsidiary of Gulf Oil Corporation.

FIELD OF THE INVENTION

This invention relates to a process for preventing polymeric deposit formation when hydrotreating a naphtha feed. More particularly, this invention relates to the treatment of raw naphtha produced in a coal liquefaction process to prevent polymer deposits from forming while heating and vaporizing the naphtha to enable the naphtha to be subjected to hydrotreating without formation of polymeric deposits in the equipment.

BACKGROUND OF THE INVENTION

Coal liquefaction processes have been developed for converting coal to a liquid fuel product. For example, U.S. Pat. No. 3,884,794 for Bull et al discloses a solvent refined coal process for producing reduced or low ash hydrocarbonaceous solid fuel and hydrocarbonaceous distillate liquid fuel from ash-containing raw feed coal in which a slurry of feed coal and recycle solvent is passed through a preheater and dissolver in sequence in the presence of hydrogen, solvent and recycled coal minerals, which increase the liquid product yield.

A portion of the distillate liquid produced in the coal liquefaction process is separated as a raw naphtha fraction. When it has been attempted to catalytically hydrotreat the naphtha fraction, polymer forming impurities produce a polymeric deposit in various parts of the system resulting in plugging of catalyst beds, process lines, heat exchangers and various other parts of the equipment.

The use of a conventional palladium catalyst-containing guard bed to hydrogenate such polymer forming impurities in the raw naphtha stream results in saturation and removal of olefins and diolefins, but such technique does not prevent significant polymer deposits from forming when the naphtha fraction is subjected to hydrotreating.

It would be highly desirable to provide a system for prevention and removal of polymer-forming impurities while heating and vaporizing the raw naphtha fractions so as to permit hydrotreating of the naphtha without significant polymer deposition and plugging.

SUMMARY OF THE INVENTION

A process has been found for preventing and removing polymer-forming impurifies, which process comprises passing a raw naphtha fraction containing polymer-forming impurities to a vaporization zone, concurrently introducing a wash oil stream into said vaporization zone along with said raw naphtha fraction, passing a stream comprising hydrogen through said vaporization zone in a direction countercurrent to said naphtha and wash oil streams, and recovering a hydrogen-vaporized naphtha stream which can be heated to hydrotreating temperatures without forming polymeric deposits. Surprisingly, it was found that the combination of using hydrogen stripping along with a hydrocarbon wash oil removes polymer coke precursors and inhibits such precursors from forming polymeric deposits while the naphtha fraction is heated and vaporized. This prevents polymer deposit formation in the vaporization zone, the hydrotreating preheater and in the hydrotreating catalyst bed. Although it is not intended to limit the present invention to any particular theory or mechanism, it is believed that the polymer precursor materials, which are not susceptible to hydrogenation using a conventional palladium catalyst guard bed, are organic compounds containing hetero-nitrogen atoms. Naphtha is subjected to hydrotreating in the vapor phase. Thus, without the process of the present invention any polymer-forming materials will polymerize and be left behind as deposits in the equipment when the naphtha is vaporized and hydrotreated. The use of the present process removes a portion of such impurities and inhibits polymer formation by the remainder of such impurities, and thus provides a means by which the naphtha can be vaporized and heated to hydrotreating reaction conditions without formation of polymer coke in the equipment.

DESCRIPTION OF THE PREFERRED EMBODIMENTS

Figure 1:
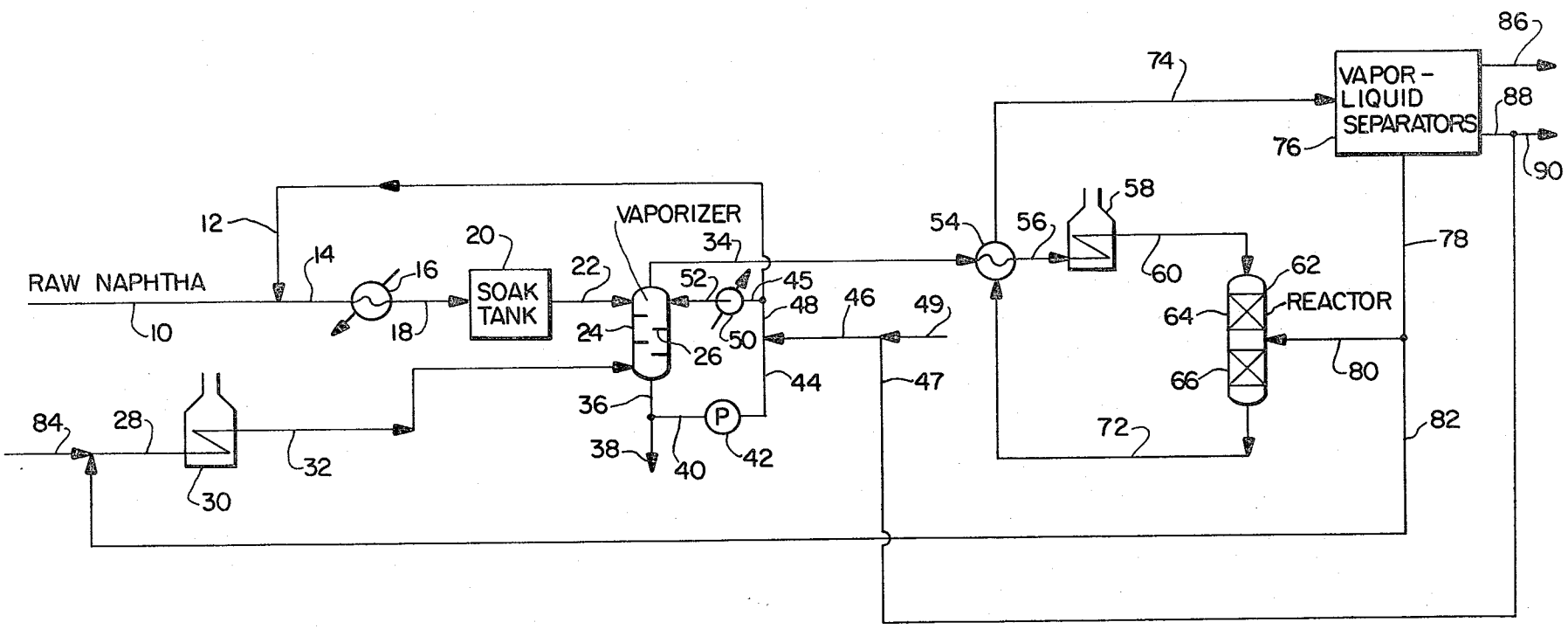
FIG. 1 is a schematic flow diagram of the process of the present invention.

As shown in the process depicted in FIG. 1 of the drawings, raw naphtha in line 10 is passed along with recycle wash oil from line 12 by means of line 14 to heat exchanger 16 wherein the naphtha-wash oil admixture is heated to a temperature in the range of from about 250° to about 350° F. (121° to about 177° C.), preferably from about 300° to about 350° F. (149° to about 177° C.). The temperature is selected so as to minimize fouling in heat exchanger 16, since at higher temperatures polymer is formed and fouls the heat exchanger surface excessively.

Any raw naphtha fraction can be treated by the process of the present invention. However, the present process is particularly suitable for treating naphtha fractions produced in a coal liquefaction process, since such fractions contain polymer precursor impurities not normally susceptible to removal by conventional saturation techniques, such as catalytic hydrogenation using a palladium catalyst.

As used in the present application, the term "naphtha" comprises a hydrocarbon fraction boiling in the range $C_5$–400° F. ($C_5$–204° C.), but not necessarily throughout the entire range. For example, a preferred boiling range is $C_5$–380° F. (193° C.) with $C_5$–350° F. (177° C.) being even more preferred. Likewise, the naphtha may have a higher initial boiling point, for example, 150° F. (66° C.) or 200° F. (93° C.). A "raw naphtha fraction" is a naphtha fraction containing polymer forming impurities. As used in the present application the expression "wash oil" includes a hydrocarbon fraction boiling in the range of between about 400° to about 800° F. (204° to about 427° C.), preferably from about 500 ° to about 800° F. (260° to about 427° C.), especially from about 550° to about 750° F. (288° to about 399° C.). An especially preferred wash oil is a distillate fraction boiling within the aforesaid ranges obtained in a coal liquefaction process, e.g., a middle distillate fraction.

The heated naphtha-wash oil mixture is passed by means of line 18 to soak tank 20 wherein the mixture is held for a residence time sufficient to permit polymer formation, since reactive polymer-forming material will react in soak tank 20, which is preferably an insulated vessel which will maintain the temperature of the naphtha-wash oil mixture without significant heat loss. A suitable residence time for the mixture in the soak tank is, for example, from about 5 to about 30 minutes, preferably from about 10 to about 20 minutes. The mixture is then passed by means of line 22 to vaporizer 24, which is provided with conventional vapor-liquid contact means 26 to permit some amount of fractionation in a stagewise manner. The vapor-liquid contact means may consist of any form of conventional packing or fractionation tray design which does not provide significant flow restrictions in the vaporizer 24 so that it does not become plugged by a small amount of polymer deposits.

Meanwhile, recycle hydrogen in line 28 is passed through fired heater 30 to heat the recycle hydrogen to a temperature in the range of from about 500° to about 1200° F. (260° to about 649° C.), preferably from about 800° to about 1000° F. (427° to about 538° C.), and the heated hydrogen is passed through line 32 into a lower portion of vaporizer 24 wherein it is passed upwardly and thus in a direction countercurrent to the generally downward flow of the naphtha-wash oil mixture which is introduced into the upper part of column 24. In this manner, the heated hydrogen strips and vaporizes the naphtha from the naphtha-wash oil mixture, while a portion of the polymer precursors and polymerized material soluble in the wash oil are absorbed in the wash oil. Any remaining polymer precursor material passes out of vaporizer 24 with the naphtha, but will not form a polymer deposit in downstream equipment.

Any suitable conditions can be utilized in vaporizer 24 which can be operated, for example, at a temperature in the range of from about 400° to about 700° F. (204° to about 371° C.), preferably from about 450° to about 650° F. (232° to about 343° C.), while under a total pressure of from about 300 to about 2500 psig (21 to about 175 kg/cm$^2$), preferably from about 1200 to about 1800 psig (84 to about 126 kg/cm$^2$). The amount of naphtha vaporized in column 24 is controlled by varying the temperature and rate of hydrogen fed to obtain maximum separation of the naphtha from the wash oil so that the maximum naphtha is carried over without excessive wash oil. For example, the naphtha in the overhead may contain from about 0 to about 20 volume percent wash oil, preferably no more than from about 5 to about 10 volume percent wash oil.

The non-vaporized liquid, which is predominantly wash oil with lesser amounts of polymerized material is discharged from vaporizer 24 through line 36. A portion of this material is withdrawn for disposal by line 38, while the remainder is passed for recycle by means of line 40 and pump 42 through line 44. Makeup wash oil is introduced into line 44 as necessary from line 46, which contains wash oil separated from the hydrotreated product in line 47 and fresh wash oil from line 49, and is passed by means of lines 48 and 45 to heat exchanger 50 wherein the recycle wash oil can be brought up to desired temperature and then introduced by means of line 52 into vaporizer column 24.

Preferably, at least a portion of the recycle wash oil in line 48 is passed by means of line 12 for admixture with raw naphtha in line 10 and passed to line 14 and heat exchanger 16 so that the naphtha-recycle wash oil mixture can be preheated together as previously described. All of the recycle wash oil in line 48 can be passed directly to line 12 for admixture with the raw naphtha. Alternatively, all or a portion of the recycle wash oil in line 48 can be passed via line 45, heater 50 and line 52 to the vaporizer.

Regardless of whether recycle wash oil is passed through one or both of lines 12 and 52, the total wash oil rate in line 48 is from about 2 to about 50 volume percent of the raw naphtha rate in line 10, and is preferably from about 5 to about 20 volume percent thereof.

The hydrogen stream 28 can comprise from about 60 to about 100 percent hydrogen on a molar basis, preferably from about 75 to about 100 mol percent hydrogen. The hydrogen in line 32 is introduced into vaporizer 24 at a rate of from about 2,000 to about 10,000 standard cubic feet of hydrogen per barrel of naphtha, preferably from about 3,000 to about 5,000 s.c.f./bbl.

A purified, vaporized hydrogen-naphtha mixture is withdrawn from vaporizer 24 by means of line 34 and passed to heat exchanger 54 to heat the mixture to a temperature of from about 500° to about 700° F. (260° to about 371° C.), preferably from about 600° to about 650° F. (316° to about 343° C.). The heated mixture is then passed by means of line 56 to furnace 58 to further raise the temperature of the mixture and can be therein heated from about 600° to about 800° F. (316° to about 427° C.), preferably from about 650° to about 750° F. (343° to about 399° C.) Furnace 58 is optional and need not be employed if the mixture is already within the desired temperature range. The heated vaporous mixture of hydrogen and naphtha is then passed by means of line 60 to hydrotreater-reactor 62 for removal of sulfur, nitrogen, olefinic and oxygen impurities.

In reactor 62 the naphtha-hydrogen mixture is subjected to a temperature in the range of from about 500° to about 800° F. (260° to about 538° C.), preferably from about 650° to about 750° F. (343° to about 399° C.) under the same pressure conditions utilized in connection with vaporizer 24. The charge stock is passed through the reactor at a liquid hourly space velocity of from about 0.2 to 3.0, preferably from about 0.8 to about 1.5 based upon the vaporized naphtha rate fed to reactor 62.

Reactor 62 is preferably provided with multiple catalyst beds 64 and 66 with hydrogen quench being injected by means of line 80 to control exothermic heat of reaction. Any suitable naphtha hydrotreating catalyst can be utilized in reactor 62 including Group VI and Group VIII metals on a support such as nickel-cobalt-molybdenum, nickel-molybdenum, cobalt-molybdenum, or the like, supported on alumina. Such catalysts are well known to this art and are described for example in U.S. Pat. No. Re. 29,315 to Carlson et al as well as in U.S. Pat. Nos. 2,880,171 and 3,383,301, the disclosures of which are hereby incorporated by reference. A nickel-molybdenum on alumina catalyst is preferred.

Hydrotreated naphtha is withdrawn from reactor 62 by means of line 72 and passed through heat exchanger 54 and line 74 to vapor-liquid separation system 76 which is composed of multiple fractionation means. Recycle hydrogen is withdrawn from vapor-liquid separation system 76 by means of line 78, and a portion of the recycle hydrogen is passed by means of line 80 to be used as quench in reactor 62. The remaining recycle hydrogen is passed by means of line 82 as recycle hydrogen for addition to line 28 and joins any makeup hydrogen added by means of line 84 for passage to vaporizer 24 as a stripping medium.

The hydrotreated naphtha is withdrawn from vapor-liquid separation system 76 by means of line 86 and is passed as reformer feedstock to a catalytic reformer system (not shown) for conversion of the naphtha to high octane gasoline and aromatics. The naphtha in line 86 preferably has a maximum ASTM end point of 400° F. which is consistent with reformer feedstock requirements, for example, less than: (1) 0.5 volume percent olefins; (2) 0.5 ppm sulfur; (3) 0.2 ppm nitrogen and (4) 5 ppm oxygen. A separated wash oil fraction is withdrawn from separation system 76 by means of line 88, and at least a portion of the recovered wash oil is recycled by means of line 47 for use in the vaporizer 24, while another portion thereof can be withdrawn from the system by means of line 90.

Vaporizer 24 and hydrotreater 62 are preferably utilized under the same total pressure except for any slight pressure drop in the connecting lines.

Figure 2:
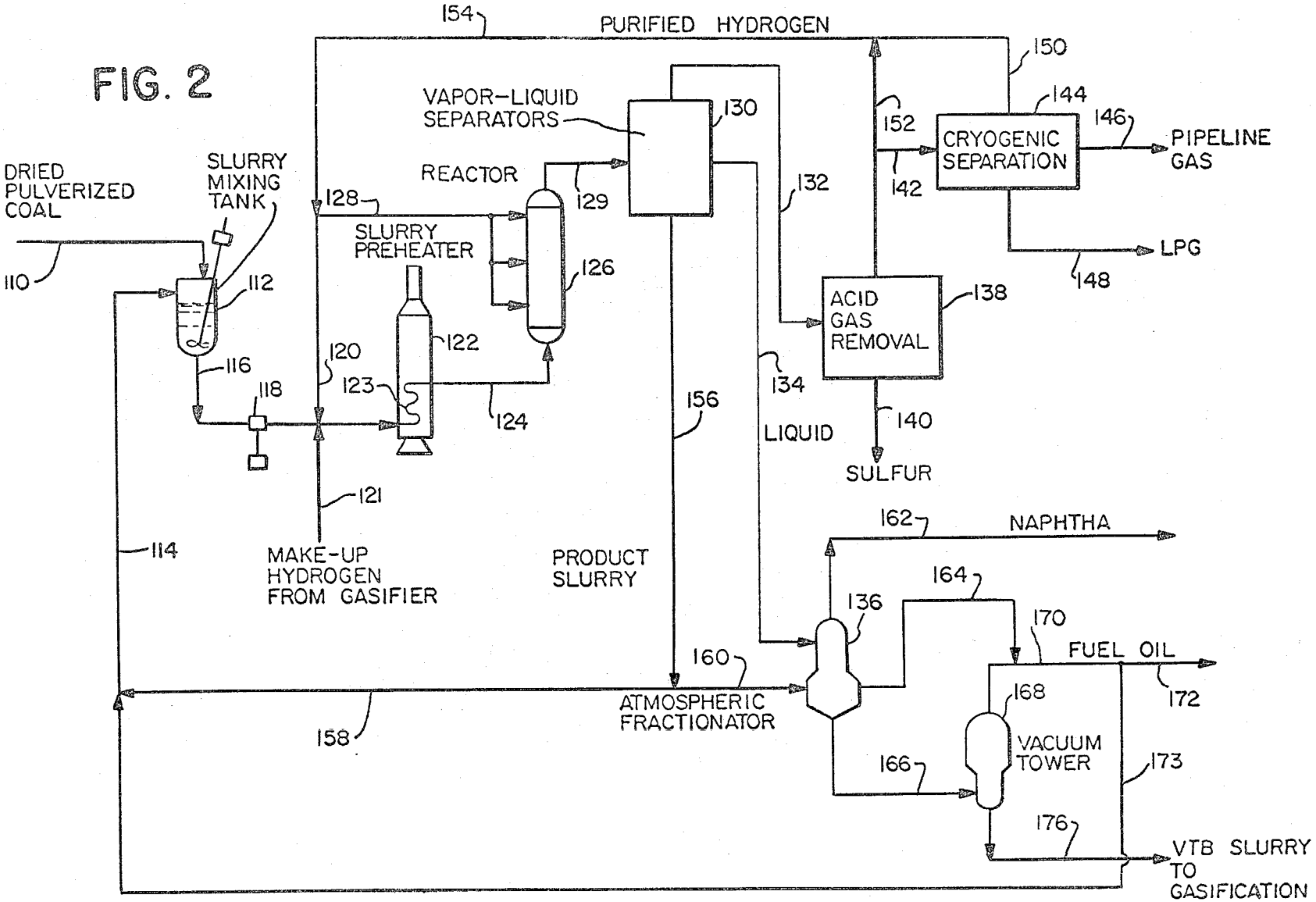
FIG. 2 is a schematic flow diagram of a preferred coal liquefaction process for producing the raw naphtha feed stock.

Referring now to FIG. 2, a preferred coal liquefaction process is shown, which process is a suitable source of the raw naphtha utilized in the process of FIG. 1. As seen in FIG. 2, dried and pulverized raw coal is passed through line 110 to slurry mixing tank 112 wherein it is mixed with recycle slurry containing recycle normally solid dissolved coal, recycle mineral residue and recycle distillate solvent boiling, for example, in the range of between about 350° F. (177° C.) to about 900° F. (482° C.) flowing in line 114. The expression "normally solid dissolved coal" refers to 900° F.+ (482° C.+) dissolved coal which is normally solid at room temperature and free of mineral matter.

The feed slurry contains, for example, from about 20 to 35 weight percent coal, and is withdrawn by means of line 116 and is pumped by means of reciprocating pump 118 and admixed with recycle hydrogen entering through line 120 and with make-up hydrogen entering through line 121 prior to passage through preheater tube 123, which is disposed in furnace 122.

The slurry is heated in furnace 122 to a temperature sufficiently high to initiate the exothermic reactions of the process. The temperature of the reactants at the outlet of the preheater is, for example, from about 700° F. (371° C.) to 760° F. (404° C.). At this temperature the coal is essentially all dissolved in the solvent, and the exothermic hydrogenation and hydrocracking reactions are beginning. Whereas the temperature gradually increases along the length of the preheater tube, the back mixed reaction is at a generally uniform temperature throughout and the heat generated by the hydrocracking reactions in the reactor raises the temperature of the reactants, for example, to the range of from about 820° F. (438° C.) to about 870° F. (466° C.). Hydrogen quench passing through line 128 is injected into the reactor at various points to control the reaction temperature.

The temperature conditions in the reactor can include, for example, a temperature in the range of from about 430° to about 470° C. (806° to 878° F.), preferably from about 445° to about 465° C. (833° to 871° F.).

The slurry undergoing reaction is subjected to a total slurry residence time of from about 1.2 to about 2 hours, preferably from about 1.4 to about 1.7 hours, which includes the nominal residence time at reaction conditions within the preheater and reaction zones.

The hydrogen partial pressure is at least about 1000 psig (70 kg/cm$^2$) and up to 4000 psi (280 kg/cm$^2$), preferably between about 1500 to about 2500 psig (105 and 175 kg/cm$^2$), with between about 2000 to about 2500 psi (140 and 175 kg/cm$^2$) being especially preferred. Hydrogen partial pressure is defined as the product of the total pressure and the mol fraction of hydrogen in the feed gas. The hydrogen feed rate is between about 1.0 and about 10.0, preferably between about 2.0 and about 6.0 weight percent based upon the weight of the slurry fed.

The slurry undergoing reaction is subjected to three-phase, highly backmixed, continuous flow conditions in reactor 126. In other words, the reaction zone is operated with thorough backmixing conditions as opposed to plug flow conditions, which do not include significant backmixing. The preheater tube 123 is also a pre-reactor and it is operated as a heated, plug-flow reactor using a nominal slurry residence time of about 2 to 15 minutes, preferably about 2 minutes.

The reaction effluent passes through line 129 to vapor-liquid separator system 130. Vapor-liquid separation system 130, consisting of a series of heat exchangers and vapor-liquid separators, separates the reactor effluent into a noncondensed gas stream 132, a condensed light liquid distillate in line 134 and a product slurry in line 156. The condensed light liquid distillate from the separators passes through line 134 to atmospheric fractionator 136. The non-condensed gas in line 132 comprises unreacted hydrogen, methane and other light hydrocarbons, along with $H_2S$ and $CO_2$, and is passed to acid gas removal unit 138 for removal of $H_2S$ and $CO_2$. The hydrogen sulfide recovered is converted to elemental sulfur which is removed from the process through line 140. A portion of the purified gas is passed through line 142 for further processing in cryogenic unit 144 for removal of much of the methane and ethane as pipeline gas which passes through line 146 and for the removal of propane and butane as LPG which passes through line 148. The purified hydrogen in line 150 is blended with the remaining gas from the acid gas treating step in line 152 and comprises the recycle hydrogen for the process.

The liquid slurry from vapor-liquid separators 130 passes through line 156 and comprises liquid solvent, normally solid dissolved coal and catalytic mineral residue. Stream 156 is split into two major streams, 158 and 160, which have the same composition as line 156.

In fractionator 136 the slurry product from line 160 is distilled at atmospheric pressure to remove an overhead naphtha stream through line 162, a middle distillate stream through line 164 and a bottoms stream through line 166. The bottoms stream in line 166 passes to vacuum distillation tower 168. The temperature of the feed to the fractionation system is normally maintained at a sufficiently high level that no additional preheating is needed other than for startup operations.

A blend of the fuel oil from the atmospheric tower in line 164 and the heavy distillate recovered from the vacuum tower through line 170 makes up fuel oil product of the process and is recovered through line 172. The stream in line 172 comprises 380°-900° F. (193°-482° C.) distillate liquid and a portion thereof can be recycled to the feed slurry mixing tank 112 through line 173 to regulate the solids concentration in the feed slurry. Recycle stream 173 imparts flexibility to the process by allowing variability in the ratio of solvent to total recycle slurry which is recycled, so that this ratio is not fixed for the process by the ratio prevailing in line 158. It also can improve the pumpability of the slurry. The portion of stream 172 that is not recycled through line 173 represents the net yield of distillate liquid from the process.

The bottoms from vacuum tower 168, consisting of all the normally solid dissolved coal, undissolved organic matter and mineral matter of the process, but essentially without any distillate liquid or hydrocarbon gases is discharged by means of line 176, and may be processed as desired. For example, such stream may be passed to a partial oxidation gasifier (not shown) to produce hydrogen for the process.

Raw naphtha stream 162 is a preferred naphtha feed stream for treatment by the process of the present invention and represents the net yield naphtha from the coal liquefaction process depicted in FIG. 2.

The naphtha stream 162 is thus utilized as raw naphtha feed to process line 10 of FIG. 1 and is treated as described in the process of FIG. 1.

EXAMPLE 1

A test was conducted to demonstrate the use of the present invention for removing polymer precursors from a naphtha fraction. The naphtha and wash oil used in the test had the following inspection. t,0130

A mixture of naphtha and wash oil wherein the wash oil constituted 20% by volume of the mixture was pumped to a feed preheater wherein it was heated to a temperature of 350° F. and then passed to a feed heat soaker for a period of 20 minutes residence time to induce polymer formation. The heated feed was then passed to the top of a vaporizor while a hydrogen stream was heated in a preheater to a temperature of 800°–970° F. and passed into the bottom of the vaporizor. The vaporizor was packed with stainless steel mesh to provide a good contact surface, and the hot hydrogen countercurrently contacted the liquid feed admixture of naphtha and wash oil therein.

The hydrogen and naphtha-wash oil mixture are subjected to a temperature of approximately 560° F. in the vaporizer. Vapor is withdrawn overhead from the vaporizor and comprises a mixture of hot hydrogen and naphtha vapors, while the vaporizor bottoms are collected.

The vaporizor overhead vapor was passed directly to a preheater where the naphtha-hydrogen admixture were preheated to a temperature of 650° F. The mixture was then passed to a reactor containing a hydrotreating catalyst and subjected to an average reactor temperature of 700° F. under a reactor pressure of 1440 psig, which substantially corresponds to the pressure in the vaporizor. The reactor effluent was passed through a cooler and separator to take off hydrogen-rich gas, and the hydrotreated naphtha product passed to a separator to remove water and then to a stabilizer column pressured to 40 psig to remove light gases and any remaining hydrogen sulfide or ammonia. The stabilized product was then collected and measured.

The vaporizor was disassembled and inspected for any blockage due to deposits and none were observed.

During this experiment no plugging was observed in the preheater nor in the reactor. At the end of the experiment the preheater and reactor were examined and no deposits were found.

EXAMPLE 2

This example is presented for comparative purposes. A test was conducted to hydrotreat a naphtha which had a composition similar to the naphtha of the previous example, but without utilizing the vaporizer of the present invention. In this case a preheater was used to heat the naphtha-hydrogen charge to reaction temperature prior to entering the catalyst bed. The naphtha-hydrogen mixture was passed directly to the preheater in which the temperature of the mixture was raised to 620° F. and passed directly to the catalyst bed.

It was observed that after several days of operation the preheater became plugged with polymeric coke so as to completely stop the flow of the naphtha-hydrogen mixture into the preheater. The reactor and preheater were disassembled and inspected. The preheater was plugged with coke deposits.

What is claimed is:

1. A process for preventing polymer formation from polymer precursor material in a naphtha fraction which comprises passing said naphtha fraction containing polymer precursor materials to a vaporization zone, introducing a wash oil stream into said vaporization zone concurrently with said naphtha fraction, passing a stream comprising heated hydrogen through said vaporization zone in a direction countercurrent to that of said naphtha-wash oil admixture, recovering a vaporized naphtha fraction from said vaporization zone which can be subjected to hydrotreating without substantial formation of polymer deposits, passing a feed consisting essentially of said vaporized naphtha fraction and hydrogen to a catalytic hydrotreating zone under hydrotreating conditions to produce a naphtha feed stock of sufficient purity to use as a reformer charge stock.

2. The process of claim 1 wherein wash oil is admixed with said naphtha prior to its introduction into said vaporization zone.

3. The process of claim 2 wherein said naphtha-wash oil admixture is preheated to a temperature in the range of from about 250° to about 350° F. (121° to about 177° C.).

4. The process of claim 2 wherein said naphtha-wash oil admixture is passed to a soaking zone prior to passage through said vaporization zone and held in said soaking zone for a period of between about 5 and about 30 minutes to permit polymerization of polymer precursor materials.

5. The process of claim 1 wherein said wash oil is a hydrocarbon fraction boiling in the range of between about 400° to about 800° F. (204° to about 427° C.).

6. The process of claim 1 wherein said vaporizor is operated at a temperature in the range of between about 400° to about 700° F. (204° to about 371° C.) and at a pressure of between about 300 to about 2500 psig.

7. The process of claim 1 wherein said hydrogen is heated to a temperature in the range of between about 500° to about 1200° F. (260° to about 649° C.) prior to introduction into said vaporization zone.

8. The process of claim 1 wherein said naphtha fraction is produced by the liquefaction of coal.

9. The process of claim 2 wherein recycled wash oil is passed into said vaporization zone along with the naphtha fraction feed.

10. The process of claim 10 wherein the total wash oil rate is from about 2 to about 50 volume percent of the rate of naphtha fed to the vaporization zone.

11. The process of claim 1 wherein the hydrogen feed rate is from about 2000 to about 10,000 standard cubic feet of hydrogen per barrel of naphtha fed to the vaporization zone.

12. The process of claim 1 wherein said vaporization zone is provided with vapor-liquid contact means which do not provide significant flow restrictions.

13. The process of claim 12 wherein said vapor-liquid contact means comprises non-catalytic packing.

14. The process of claim 12 wherein said vapor-liquid contact means comprises fractionation trays.

15. The process of claim 4 wherein said soaking zone is operated at a temperature of from about 250° to about 350° F.

16. The process of claim 1 wherein a hydrotreated naphtha stream is withdrawn from said catalytic hydrotreating zone and passed to a separation zone wherein hydrogen is separated from hydrotreated naphtha, and said hydrotreated naphtha is recycled to said vaporization zone and passed therethrough in a direction countercurrent to that of said naphtha-wash oil mixture.

17. The process of claim 1 wherein said vaporization zone is located in a first vessel and said hydrotreating zone is located in a second vessel.

* * * * *